US012674592B2

(12) United States Patent
Park et al.

(10) Patent No.: US 12,674,592 B2
(45) Date of Patent: Jul. 7, 2026

(54) AIR CLEANER

(71) Applicant: SAMSUNG ELECTRONICS CO., LTD., Suwon-si (KR)

(72) Inventors: Juwan Park, Suwon-si (KR); Juyoung Kim, Suwon-si (KR); Sunghyun Chun, Suwon-si (KR); Nakhyun Kim, Suwon-si (KR); Changhyun Park, Suwon-si (KR); Moonsun Shin, Suwon-si (KR); Wonhee Lee, Suwon-si (KR); Changwoo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 665 days.

(21) Appl. No.: 17/895,408

(22) Filed: Aug. 25, 2022

(65) Prior Publication Data

US 2022/0404045 A1 Dec. 22, 2022

Related U.S. Application Data

(63) Continuation of application No. PCT/KR2021/005483, filed on Apr. 29, 2021.

(30) Foreign Application Priority Data

Jun. 25, 2020 (KR) ..... 10-2020-0077694

(51) Int. Cl.
*F24F 8/22* (2021.01)
*F24F 7/007* (2006.01)
(Continued)

(52) U.S. Cl.
CPC ..... *F24F 8/22* (2021.01); *F24F 7/007* (2013.01); *F24F 8/167* (2021.01); *F24F 8/80* (2021.01)

(58) Field of Classification Search
CPC .... A61L 9/20; A61L 9/205; F24F 8/22; F24F 8/167; F24F 8/80
See application file for complete search history.

(56) References Cited

U.S. PATENT DOCUMENTS 11,504,445 B2 11/2022 Watanabe et al.
2010/0196222 A1* 8/2010 Kosugi ..... B01D 53/885 422/186
(Continued)

FOREIGN PATENT DOCUMENTS

CN 105042709 A 11/2015
CN 211854399 11/2020
(Continued)

OTHER PUBLICATIONS

Translated International Search Report dated Jul. 26, 2021 for International Application No. PCT/KR2021/005483.
(Continued)

*Primary Examiner* — Donald R Spamer
*Assistant Examiner* — Kayla Rose Sarantakos
(74) *Attorney, Agent, or Firm* — STAAS & HALSEY LLP

(57) ABSTRACT

An air cleaner capable of removing bacteria and viruses. The air cleaner includes: a main body including a suction hole through which air is introduced and a discharge hole through which air is discharged; an ultraviolet (UV) irradiation device disposed between the suction hole and the discharge hole, and including a UV light emitting diode (LED) configured to transmit ultraviolet rays toward the discharge hole; a photocatalyst filter including a photocatalyst provided to generate active oxygen by reacting with the UV rays transmitted from the UV LED, and disposed between the UV irradiation device and the discharge hole; and a light blocking member disposed between the UV LED and the suction hole to prevent the UV rays transmitted from the UV
(Continued)

1

LED from being emitted to an outside of the main body through the suction hole.

16 Claims, 14 Drawing Sheets

(51) Int. Cl.
*F24F 8/167* (2021.01)
*F24F 8/80* (2021.01)

(56) References Cited

U.S. PATENT DOCUMENTS

| | | | | |
|---|---|---|---|---|
| 2016/0325606 | A1* | 11/2016 | Kim | B60H 1/00521 |
| 2018/0344890 | A1 | 12/2018 | Watanabe et al. | |
| 2020/0355378 | A1* | 11/2020 | Jeong | B01D 46/645 |

FOREIGN PATENT DOCUMENTS

| | | | |
|---|---|---|---|
| JP | 11-104225 | A | 4/1999 |
| JP | 3230454 | B2 | 11/2001 |
| JP | 2005-337549 | A | 12/2005 |
| JP | 2009-233074 | | 10/2009 |
| JP | 2017-148484 | | 8/2017 |
| JP | 3226941 | | 7/2020 |
| KR | 10-0313891 | B1 | 11/2001 |
| KR | 10-0622261 | B1 | 9/2006 |
| KR | 10-2008-0110155 | A | 12/2008 |
| KR | 10-0946106 | B1 | 3/2010 |
| KR | 10-2010-0082639 | A | 7/2010 |
| KR | 10-1334294 | B1 | 11/2013 |
| KR | 10-1400250 | B1 | 5/2014 |
| KR | 10-2014-0070497 | A | 6/2014 |
| KR | 10-2015-0028163 | A | 3/2015 |
| KR | 10-2015-0062581 | | 6/2015 |
| KR | 10-2015-0071255 | A | 6/2015 |
| KR | 10-2004433 | B1 | 7/2019 |
| KR | 10-2066262 | B1 | 1/2020 |

OTHER PUBLICATIONS

Notice Requestion Submission of Opinion issued Nov. 8, 2024 for Korean Application No. 10-2020-0077694.

Korean Office Action dated May 30, 2025 for Korean Application No. 10-2020-0077694.

* cited by examiner

AIR CLEANER

CROSS-REFERENCE TO RELATED APPLICATION(S)

This application is a continuation application, under 35 U.S.C. § 111(a), of International Application No. PCT/KR2021/005483, filed on Apr. 29, 2021, which is based on and claims priority under 35 U.S.C. § 119 to Korean Patent Application No. 10-2020-0077694, filed on Jun. 25, 2020, in the Korean Intellectual Property Office, the disclosures of which are incorporated by reference herein in their entirety.

BACKGROUND

1. Field

The disclosure relates to an air cleaner, and more specifically, to an air cleaner including an ultraviolet irradiation device.

2. Description of Related Art

An air cleaner is a device that sucks in polluted air, filters out dust and odor particles contained in the air with a filter to purify the sucked air into clean air, and discharges the purified air back to the outside of the air cleaner.

Recently, there is an increasing need to remove bacteria and viruses as well as fine dust contained in the air. Accordingly, research on an air cleaner capable of removing bacteria and viruses is being conducted.

SUMMARY

According to an aspect of the disclosure, there is provided an air cleaner including: a main body including a suction hole through which air is introduced into the air cleaner and a discharge hole through which the air is discharged from the air cleaner; an ultraviolet (UV) irradiation device disposed between the suction hole and the discharge hole, and including a UV light emitting diode (LED) to emit UV rays toward the discharge hole; a photocatalyst filter including a photocatalyst to generate active oxygen by reacting with the UV rays emitted from the UV LED, and the photocatalyst filter disposed between the UV irradiation device and the discharge hole; and a light blocking member disposed between the UV LED and the suction hole to prevent the UV rays emitted from the UV LED from being emitted to an outside of the main body through the suction hole.

The light blocking member may be a first light blocking member, and the air cleaner may further include a second light blocking member disposed between the UV LED and the discharge hole to prevent the UV rays emitted from the UV LED from being emitted to the outside of the main body through the discharge hole.

The air cleaner may further include a filter to filter out dust from the air introduced into the main body, and disposed between the suction hole and the UV irradiation device.

The UV irradiation device may further include a filter accommodating part to allow the filter to be mountable to and demountable therefrom and including an air flow-in part provided to allow air to pass therethrough.

The UV irradiation device may further include: a case including the filter accommodating part; a substrate on which the UV LED is mountable; and a heat sink provided to come in contact with the substrate to absorb heat of the substrate.

The light blocking member may be disposed between the case and the heat sink, and provided to cover one side of the case facing the heat sink.

The heat sink may be disposed between the case and the substrate to come in contact with the air passed through the air flow-in part.

The first light blocking member and the second light blocking member may include fabric.

The air cleaner may further include: a fan disposed inside the main body to cause the air to flow into the cleaner; a fan case including an opening corresponding to the fan and guiding the air passed through the UV irradiation device and the photocatalyst filter to be directed to the fan; and a grille cover couplable to the fan case to cover the opening.

The second light blocking member may be provided to cover the opening or the grille cover to prevent UV rays from passing through the opening.

The photocatalyst may include titanium oxide (TiO2).

The air cleaner may further include a filter case in which the UV irradiation device and the photocatalytic filter are mountable to and demountable from the filter case, wherein the filter case may include a first contact point and a second contact point.

The UV irradiation device may further include a third contact point corresponding to the first contact point and a fourth contact point corresponding to the second contact point, and while the first contact point and the third contact point are in contact, and the second contact point and the fourth contact point are in contact, the UV irradiation device may be provided to receive power from the main body.

The UV irradiation device may further include a substrate accommodating part couplable to the case to accommodate the UV LED, the substrate, and the heat sink, wherein the substrate accommodating part may include: an UV hole through which the UV rays transmitted from the UV LED are emitted; and a heat dissipation groove provided to increase a contact area between the substrate and the air.

The suction hole may be formed on a rear surface of the main body, and the discharge hole is formed on a front surface of the main body.

According to an aspect of the disclosure, there is provided an air cleaner including: a main body in which a suction hole and a discharge hole are arranged such that air is introduced from a rear side and discharged to a front side; a filter configured to filter the air introduced into the main body through the suction hole and disposed to face the suction hole; and an ultraviolet light emitting diode (UV LED) configured to transmit UV rays toward the front, an UV irradiation device disposed in front of the filter; a photocatalytic filter disposed in front of the UV irradiation device; and a light blocking member disposed between the UV LED and the discharge hole to prevent the UV rays transmitted from the UV LED from leaking to the front of the main body.

When the light blocking member is a first light blocking member, the air purifier may further include a second light blocking device disposed between the UV LED and the suction hole to prevent the UV rays transmitted from the UV LED from being emitted to the outside of the body through the suction hole.

The filter may be detachably mounted to the ultraviolet irradiation device.

The first light blocking member and the second light blocking member may include a fabric.

According to an aspect of the disclosure, there is provided an air cleaner including: a main body in which a suction hole and a discharge hole are arranged such that air is introduced from a rear side and discharged to a front side; and an ultraviolet light emitting device (UV LED) configured to transmit UV rays toward the front, and also including: an UV irradiation device disposed in front of the filter; a photocatalytic filter disposed in front of the UV irradiation device; a first light blocking member disposed between the UV LED and the suction hole to prevent the UV rays transmitted from the UV LED from being reflected rearward and thus leaking to the rear side of the main body; and a second light blocking member disposed between the UV LED and the discharge hole to prevent the UV rays transmitted from the UV LED from leaking to the front side of the main body.

BRIEF DESCRIPTION OF THE DRAWINGS

The above and other aspects, features, and advantages of the certain embodiments of the present disclosure will be more apparent from the following description taken in conjunction with the accompanying drawings, in which.

DETAILED DESCRIPTION

Figure 1:
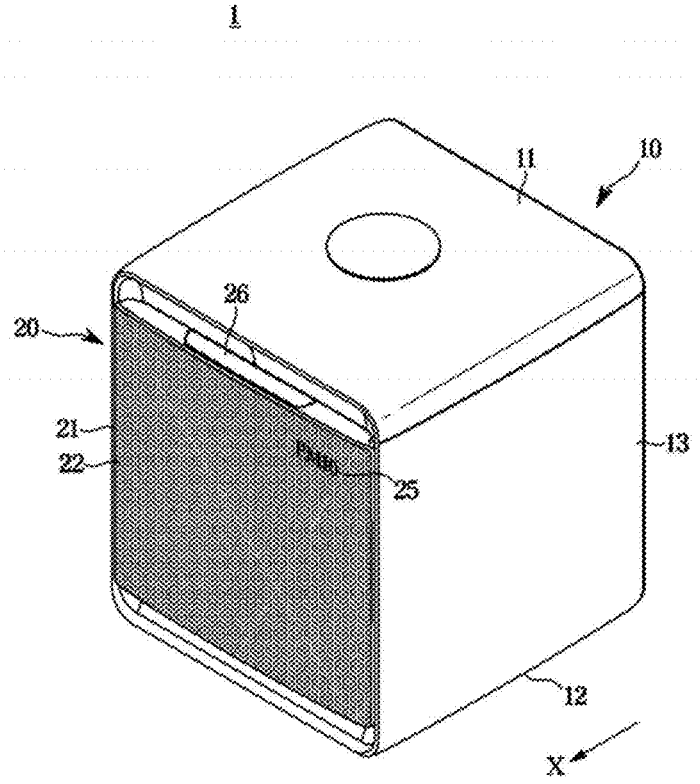
FIG. 1 is a front perspective view illustrating an air cleaner according to an embodiment of the disclosure.

Embodiments described in the specification and configurations shown in the accompanying drawings are merely exemplary examples of the disclosure, and various modifications may replace the embodiments and the drawings of the disclosure at the time of filing of the application.

Further, identical symbols or numbers in the drawings of the disclosure denote components or elements configured to perform substantially identical functions.

Further, terms used herein are only for the purpose of describing particular embodiments and are not intended to limit to the disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the disclosure. The term "and/or" includes combinations of one or all of a plurality of associated listed items.

The terms "front", "rear", "left", "right", and the like as herein used are defined with respect to the drawings, but the terms may not restrict the shape and position of the respective components.

According to an aspect of the disclosure, an air cleaner capable of removing bacteria and viruses can be provided.

According to an aspect of the disclosure, an air cleaner capable of removing bacteria and viruses by irradiating a photocatalyst with ultraviolet rays to generate active oxygen can be provided.

According to an aspect of the disclosure, an air cleaner capable of blocking UV rays transmitted from the inside of the from being emitted to the outside of the main body can be provided.

Figure 2:
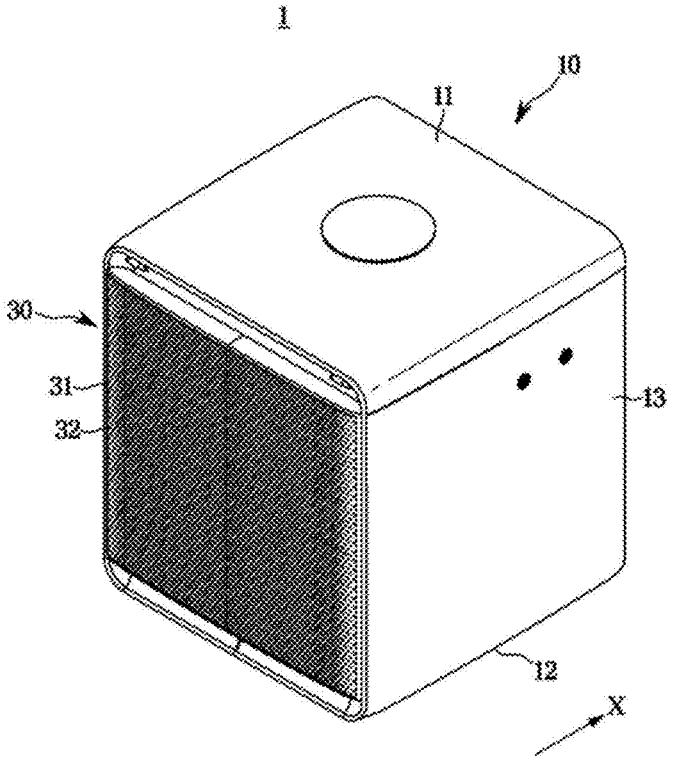
FIG. 2 is a rear perspective view illustrating an air cleaner according to an embodiment of the disclosure.
Figure 3:
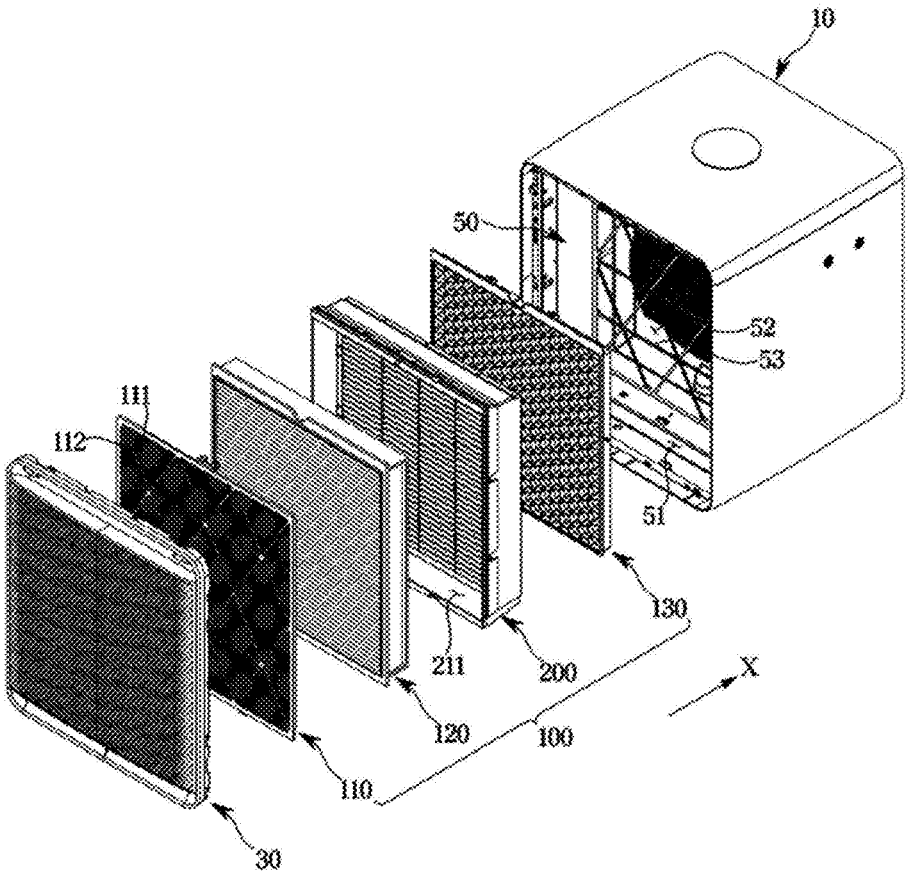
FIG. 3 is a schematic exploded perspective view illustrating an air cleaner according to an embodiment of the disclosure.

FIG. 1 is a front perspective view illustrating an air cleaner according to an embodiment of the disclosure. FIG. 2 is a rear perspective view illustrating an air cleaner according to an embodiment of the disclosure. FIG. 3 is a schematic exploded perspective view illustrating an air cleaner according to an embodiment of the disclosure.

When the X direction shown in FIGS. 1 to 3 is referred to as a first direction, the first direction indicates a direction from the rear to the front.

Referring to FIGS. 1 and 2, an air cleaner 1 has a main body 10 forming the external appearance, a front panel 20 coupled to the front of the main body 10 to form a front surface of the air cleaner 1, and a rear panel 30 coupled to the rear of the main body 10 to form a rear surface of the air cleaner 1.

The main body 10 may include an upper panel 11 forming an upper surface, a lower panel 12 forming a lower surface, and side panels 13 forming opposite side surfaces. The front panel 20 and the rear panel 30 may be provided on the front side and the rear side of the main body 10, respectively.

The front panel 20 may be formed in a plate shape. The front panel 20 may be provided with a discharge part 21 for discharging purified air inside the main body 10. The discharge part 21 may include an outlet 22. The outlet 22 may be provided on the front surface of the front panel 20. The outlet 22 may be formed in at least one unit thereof. The number or arrangement of the discharge holes 22 is not limited, and may be provided such that air may be discharged in various directions. Although the front panel of the embodiment is illustrated as being separately configured on the front side of the main body, the aspect of the disclosure is not limited thereto. For example, the front panel may be integrally formed with the main body.

The front panel 20 may be provided with an operation button part 26 for inputting an operation of the air cleaner 1, and a display part 25 provided to display an operation state.

The rear panel 30 may be formed in a plate shape having a size corresponding to the rear surface of the main body 10. The rear panel 30 may be provided with a suction part 31 for introducing external air. The suction part 31 may include a plurality of suction holes 32 that are evenly distributed over the entire area of the rear panel 30. The inlet 32 is not limited in number or arrangement position. For example, the plurality of suction holes 32 may be provided only in a portion of the suction part 31.

The suction part 31 of the rear panel 30 may be formed such that external air is introduced in a direction of an inner side of the main body 10 from the rear surface of the main body 10. Air introduced into the main body 10 through the suction part 31 may be discharged through the discharge part 21 of the front panel 20. In other words, air may be introduced through the rear panel 30 of the main body 10 in the first direction X and discharged through the front panel 20.

The air cleaner 1 may include a filter device 100 installed inside the main body 10, a filter case 50, a fan case 60, and a blower device.

The filter device 100 may be mounted inside the main body 10 to filter out dust in the air introduced through the suction part 31 of the rear panel 30. In addition, according to an aspect of the disclosure, the filter device 100 may include an ultraviolet (UV) irradiation device 200 and a photocatalytic filter 130 to remove bacteria and viruses in the air.

According to an embodiment of the disclosure, the filter device 100 may include a primary filter 110, a secondary filter 120, the ultraviolet irradiation device 200, and the photocatalytic filter 130.

The primary filter 110 may be provided to filter out dust in the air. The primary filter 110 may be disposed adjacent to the suction part 31. The primary filter 110 may include a pre-filter 111 that collects dust, foreign substances, and the like larger than or equal to a preset size. The primary filter 110 may include a filter support 112 provided to support the pre-filter 111. The pre-filter 111 may be provided to cover an opening formed in between the filter support 112.

The primary filter 110 may be provided to be disposed rearmost in the first direction X in the main body 10 among the components of the filter device 100.

The secondary filter 120 may be provided to collect foreign substances of a certain size having passed through the primary filter 110. The secondary filter 120 may be a high efficiency particulate air (HEPA) filter that collects fine dust of a certain size. The HEPA filter may be composed of glass fibers. However, the disclosure is not limited thereto, and the secondary filter 120 may be provided in various types of filters collecting foreign substances.

The secondary filter 120 may be disposed in front of the primary filter 110.

The secondary filter 120 may be detachably mounted to the UV irradiation device 200. The secondary filter 120 may be mounted on a filter accommodating part 211 formed in the UV irradiation device 200. The secondary filter 120 may be separated from the UV irradiation device 200. According to an embodiment of the disclosure, the air cleaner 1 may operate even when the secondary filter 120 is not mounted on the UV irradiation device 200.

The UV irradiation device 200 and the photocatalytic filter 130 will be described below.

The filter case 50 may be provided to accommodate the filter device 100. In other words, the filter device 100 may be installed in the filter case 50. The filter case 50 may be coupled to be fixed to the inside of the main body 10. The filter case 50 may accommodate the filter device 100, so that the filter device 100 may be fixed to the inside of the main body 10.

The filter case 50 may include a filter device accommodating part 51 provided to accommodate the filter device 100. The filter device accommodating part 51 may be formed by one side of the filter case 50 that is open. The filter device 100 may be detachably mounted to the filter device accommodating part 51.

The filter case 50 may include an air passage hole 52 formed on the other side thereof to allow air purified through the filter device 100 to flow, and a rib 53 configured to prevent the filter device 100 from passing forward of the filter case 50. The air passage hole 52 may be provided in plural. The air passage hole 52 may be formed by the rib 53 provided on the open other side of the filter case 50. The air passage hole 52 forms an air flow path such that the air passed through the filter device 100 may move to the fan case 60 (see in FIG. 8) and a grille cover (71 in FIG. 8). The air passed through the filter device 100 may move in the first direction X in the main body 10 through the air passage hole 52. The filter device 100 may be fixed without being moved in the first direction X in the filter case 50 by the rib 53. The rib 53 and the air passage hole 52 may prevent the filter device 100 from passing through the filter case 50 in the first direction X while allowing air passed through the filter device 100 to pass through the filter case 50 in the first direction X.

According to an embodiment of the disclosure, the air passage holes 52 may be provided in plural as shown in FIG. 3. However, the disclosure is not limited thereto and a single air passage hole may be provided.

Figure 4:
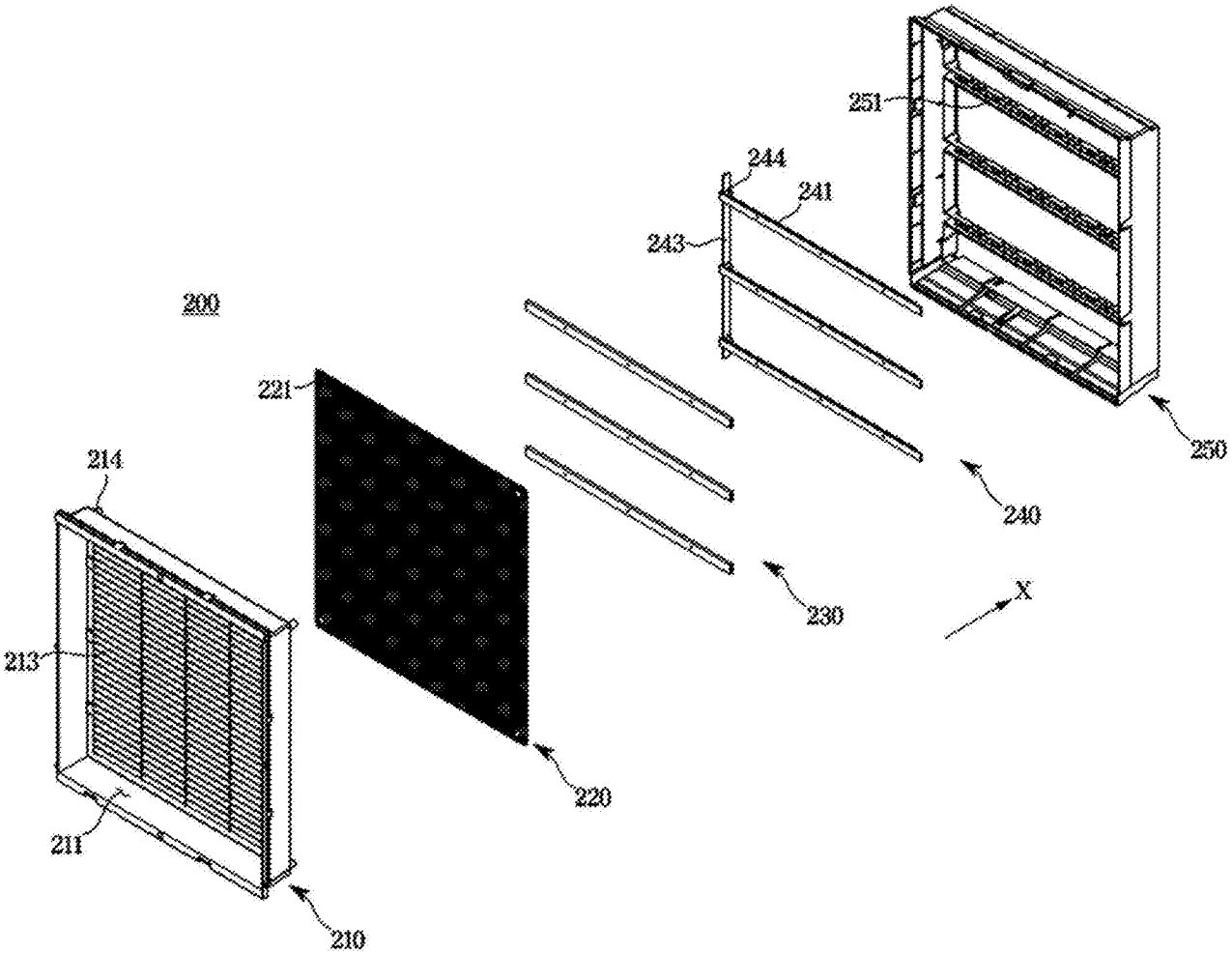
FIG. 4 is an exploded perspective view illustrating an ultraviolet irradiation device, in an air cleaner according to an embodiment of the disclosure.

FIG. 4 is an exploded perspective view illustrating an ultraviolet irradiation device, in an air cleaner according to an embodiment of the disclosure.

Hereinafter, the specific configuration of the UV irradiation device will be described in detail.

Referring to FIG. 4, the UV irradiation device 200 may include a first case 210, a first light blocking member 220, a heat sink 230, an UV generator 240, and a second case 250.

The first case 210 may include a filter accommodating part 211 provided to mount the primary filter 110 and the secondary filter 120 thereon. The filter accommodating part 211 may indicate a space formed in an inner side of the first case 210.

The first case 210 may include a blocking wall 213 provided to block UV rays transmitted forward from the UV LED 242, which will be described below, from being reflected and emitted to the rear side of the first case 210. The blocking wall 213 may be provided in plural, and an air flow-in part 212 may be formed between the blocking walls.

In addition, the first case 210 may include a coupling protrusion 214 provided to be inserted into a first coupling hole 221 of the light blocking member 220 to be described below. The coupling protrusion 214 may protrude from the front surface of the first case 210 in the first direction X. The coupling protrusion 214 may be provided at each of four corners of the first case 210.

According to the aspect of the disclosure, the UV irradiation device 200 may include the light blocking member 220. In this specification, the light blocking member 220 is referred to as a first light blocking member. In addition, a light blocking member 80 to be described below is referred to as a second light blocking member.

The first light blocking member 220 may be provided to prevent UV rays transmitted from the UV LED 242 in the first direction X from being reflected backward in the main body 10 and emitted to the outside of the main body 10. The first light blocking member 220 may be formed of various materials. For example, the first light blocking member 220 may be formed of a fabric material. The first light blocking member 220 may be provided in a black color to easily absorb light. In addition, the first light blocking member 220 may be formed of an elastic material. Alternatively, the first light blocking member 220 may be provided as a thin metal plate, and in this case, may include a plurality of holes formed over the entire surface. In addition, the first light blocking member may be formed of an injection-molded material rather than fabric or metal material.

According to an embodiment of the disclosure, the first light blocking member 220 may be formed of a fabric material. The first light blocking member 220 may include first coupling holes 221 formed at the four corners of the first light blocking member 220, respectively. The first light blocking member 220 may be coupled to the first case 210 as the coupling protrusion 214 of the first case 210 is inserted into the first coupling hole 221. The first light blocking member 220 may be coupled to the first case 210 to cover the entire area of the front surface of the first case 210. Even when UV rays transmitted from the UV LED 242 are reflected to the rear side of the main body 10, since the first light blocking member 220 covers the entire area of the front surface of the first case 210, the UV rays discharged to the rear side of the main body 10 may be completely blocked.

The UV irradiation device 200 may include the UV generator 240 and the heat sink 230.

The UV generator 240 may include a UV LED 242 and a substrate 241 on which the UV LED 242 is mounted. According to an embodiment of the disclosure, a plurality of the UV LEDs 242 may be mounted on one substrate 241, and the substrate 241 may be provided in plural. For example, three UV LEDs 242 may be mounted on one substrate 241, and the substrate 241 may be provided in three units thereof. However, the number of UV LEDs mounted on the substrate and the number of substrates may be changed according to design specifications.

According to an embodiment of the disclosure, the UV LED 242 may transmit UV-A of a relatively long wavelength. By using UV-A, which is not dangerous to the human body compared to UV-C of a short wavelength, even when the light blocking members 220 and 80 are torn, the risk due to exposure to UV rays may be minimized.

In addition, according to an embodiment of the disclosure, the plurality of UV LEDs 242 may be simultaneously turned on as the main body 10 operates. Alternatively, the plurality of UV LEDs 242 may be sequentially turned on starting from the UV LEDs 242 disposed in a portion in which a relatively large amount of air is introduced in consideration of power consumption. In addition, when the UV LED 242 operates for a long time, harmful substances, such as ozone, may be generated in the main body 10. To prevent the limitation, the UV LED 242 may be set to be turned off after a first predetermined time of operation. The UV LED 242 may be set to be turned on when a second predetermined time elapses after being turned off. In this case, the first predetermined time and the second predetermined time may be the same as or different from each other.

The UV generator 240 may include a connection substrate 243 electrically connecting the plurality of substrates 241 to each other. Each of the plurality of substrates 241 may be coupled to the connection substrate 243 through a connector 244 provided on the connection substrate 243. The plurality of substrates 241 may be coupled to the connection substrate 243 to thereby simultaneously receive power through the connection substrate 243.

The heat sink 230 may be provided to correspond to the substrate 241. The heat sink 230 and the substrate 241 may extend in a direction crossing the first direction X. The heat sink 230 and the substrate 241 may extend in the left-right direction of the main body 10. The heat sink 230 may come in contact with the substrate 241 to absorb heat generated from the substrate 241 and the UV LED 242. The heat sink 230 may be formed of a material having high thermal conductivity. The heat sink 230 may rapidly absorb heat generated from the substrate 241 and the UV LED 242. In addition, the heat sink 230 may come in contact with air to rapidly transfer the heat absorbed from the heat sink 230 to the air.

The UV irradiation device 200 may include the second case 250. The second case 250 may be provided to be coupled to the first case 210. The first light blocking member 220, the heat sink 230, and the UV generator 240 may be provided between the first case 210 and the second case 250. The second case 250 may include a substrate accommodating part 251 configured to accommodate the substrate 241 and the UV LED 242 therein. The substrate accommodating part 251 may be coupled in a direction from the front of the substrate 241 and the UV LED 242.

Figure 5:
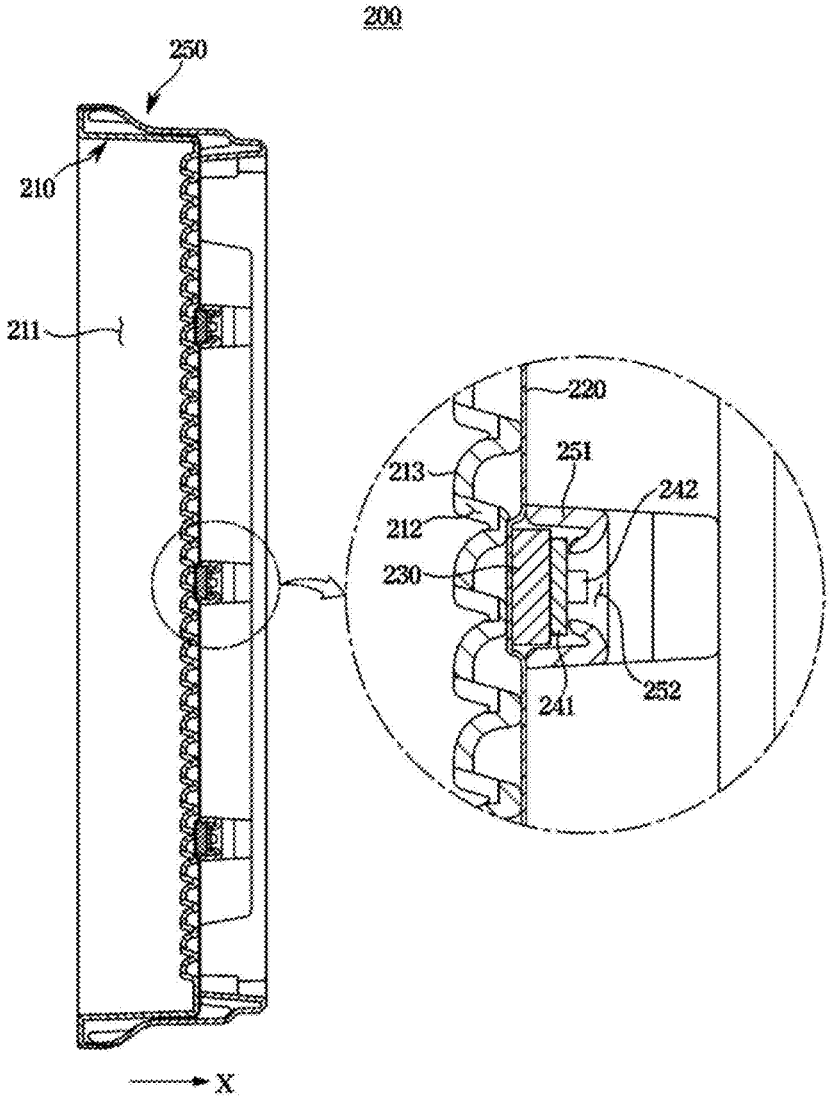
FIG. 5 is a side cross-sectional view illustrating an ultraviolet irradiation device, in an air cleaner according to an embodiment of the disclosure.

FIG. 5 is a side cross-sectional view illustrating an ultraviolet irradiation device of an air cleaner according to an embodiment of the disclosure.

Referring to FIG. 5, the first case 210 may include the blocking wall 213 that prevents UV rays from being emitted to the outside of the first case 210. The blocking wall 213 may be provided in plural, and an air flow-in part 212 may be provided between the blocking walls.

The blocking wall 213 may be provided to extend downward to prevent UV rays from being emitted to the rear side of the first case 210. The blocking wall 213 may guide the UV rays downward even when the UV rays are emitted to the rear side of the first case 210. Even when UV rays are emitted toward the lower rear side of the main body 10, since no person is generally present on the lower rear side of the main body 10, problems due to emission of UV rays may be minimized.

According to the aspect of the disclosure, by including the first light blocking member 220, UV rays may be blocked from being emitted to the rear side of the main body 10. The first light blocking member 220 may include fine holes that allow air to pass therethrough. As described above, the first light blocking member 220 may be formed of a fabric material to have ventilation. The first light blocking member 220 may be provided to pass air while blocking UV rays. The first light blocking member 220 may cover the entire area of one surface of the first case 210.

Hereinafter, heat dissipation of the UV generator 240 through the heat sink 230 in the air cleaner 1 according to an embodiment of the disclosure will be described with reference to FIG. 5.

According to an embodiment of the disclosure, air may be suctioned from the rear of the main body 10 and discharged to the front of the main body 10. Air suctioned through the suction part 31 of the rear panel 30 may pass through the primary filter 110 and the secondary filter 120 and flow into the UV irradiation device 200. The air flowing into the UV irradiation device 200 may be moved in the first direction X through the air flow-in part 212 of the first case 210. The air may come into contact with the heat sink 230 while moving in the first direction X. The air in contact with the heat sink 230 may absorb heat from the heat sink 230. Accordingly, the temperature of the heat sink 230 is lowered. The first light blocking member 220 may be disposed between the heat sink 230 and the air flow-in part 212. Since air may pass through the first light blocking member 220, the air may come into contact with the heat sink 230 after passing through the first light blocking member 220.

On the front surface of the heat sink 230, the substrate 241 may be disposed. The rear surface of the substrate 241 and the front surface of the heat sink 230 may be provided to be in contact with each other.

The substrate 241 and the UV LED 242 may be accommodated in the substrate accommodating part 251 of the second case 250. The substrate 241 and the UV LED 242 may be fixed by the substrate accommodating part 251 and the blocking wall 213. The substrate accommodating part 251 may include a UV hole 252 such that the UV rays transmitted from the UV LED 242 move forward.

Figure 6:
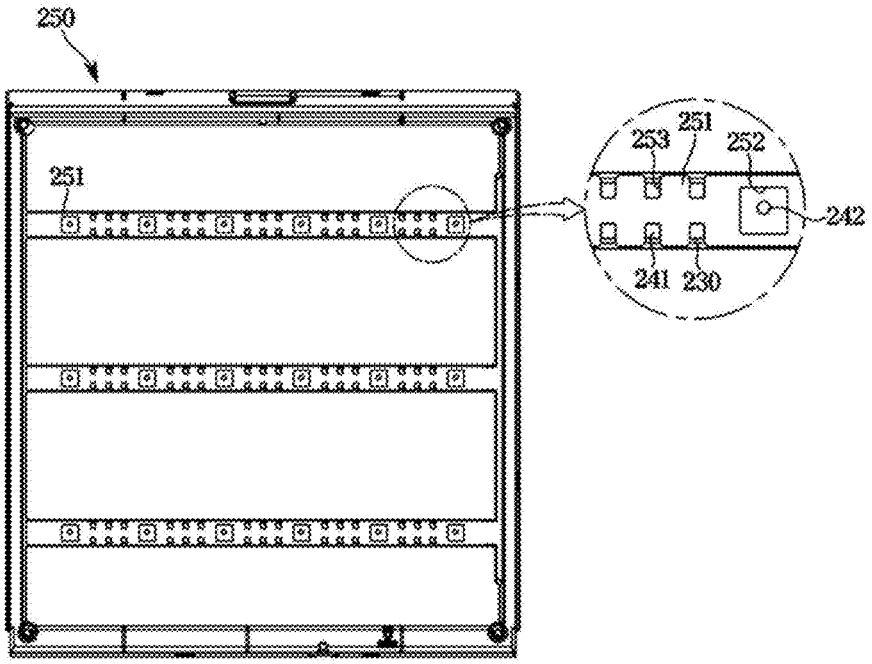
FIG. 6 is a front view illustrating a portion of an ultraviolet irradiation device, in an air cleaner according to an embodiment of the disclosure from the front.

FIG. 6 is a front view illustrating a portion of an ultraviolet irradiation device, in an air cleaner according to an embodiment of the disclosure from the front.

Referring to FIG. 6, according to an embodiment of the disclosure, the substrate accommodating part 251 may include the UV hole 252 provided to allow UV rays transmitted from the UV LED 242 to pass therethrough. In addition, the substrate accommodating part 251 may further include a heat dissipation groove 253 provided to increase a contact area between the substrate 241 and air.

The heat sink 230 may be provided on the rear surface of the substrate 241 such that heat generated from the substrate 241 is dissipated through the heat sink 230. In front of the substrate 241, the substrate accommodating part 251 is disposed, and the substrate accommodating part 251 may be provided with a plurality of heat dissipation grooves 253 to increase the area in which the front surface of the substrate 241 comes in contact with air. Through this, the substrate 241 may heat-exchange with air while in contact with air, and heat of the substrate 241 may be more rapidly discharged to the outside.

Figure 7:
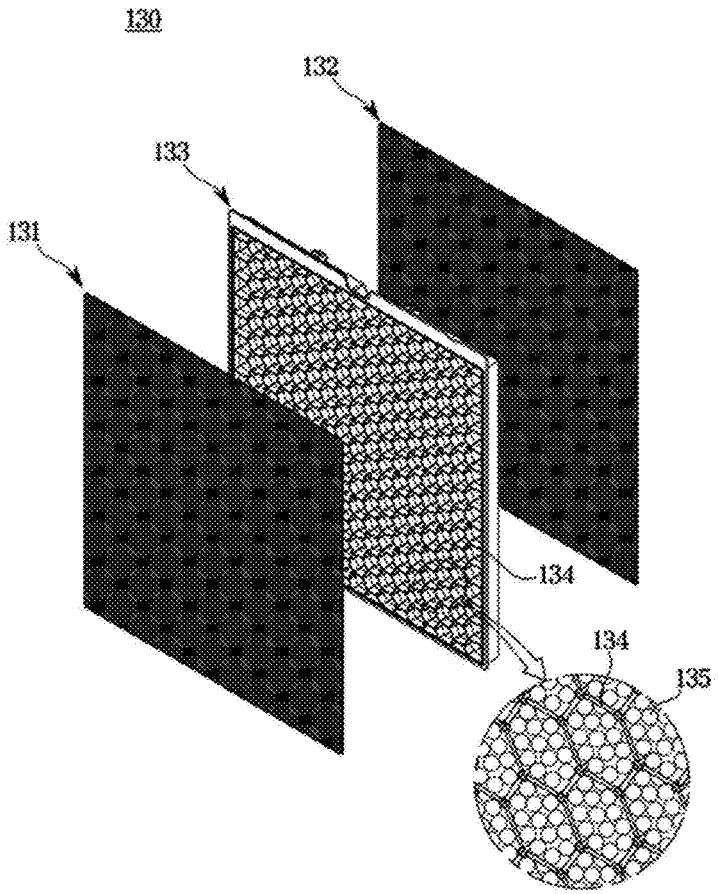
FIG. 7 is an exploded view illustrating a photocatalytic filter, in an air cleaner according to an embodiment of the disclosure.

FIG. 7 is an exploded view illustrating a photocatalytic filter, in an air cleaner according to an embodiment of the disclosure.

Referring to FIG. 7, the air cleaner 1 according to an embodiment of the disclosure may include a photocatalytic filter 130.

The photocatalytic filter 130 may be disposed in front of the UV irradiation device 200. According to an embodiment of the disclosure, air in an indoor space in which the air cleaner 1 is disposed may be introduced into the main body 10 through the suction part 31 disposed on the rear side of the main body 10, and may be discharged through the discharge part 21 disposed on the front side of the main body 10. According to the flow of airflow, air may pass through the primary filter 110, the secondary filter 120, and the UV irradiation device 200, and then pass through the photocatalytic filter 130.

The photocatalyst filter 130 may include a plurality of photocatalysts 135, a frame 133 including a plurality of photocatalyst accommodating parts 134 provided to accommodate the photocatalysts 135, and a first cover 131 and a second cover 132 provided to cover a front surface and a rear surface of the frame 133, respectively.

The photocatalyst 135 may be provided to generate active oxygen by reacting with UV rays. When the photocatalyst 135 are irradiated with UV rays, active oxygen may be generated in the photocatalyst 135, and the active oxygen may remove bacteria and viruses.

According to an embodiment of the disclosure, the photocatalyst 135 may include titanium oxide $TiO_2$. When titanium oxide $TiO_2$ is irradiated with UV rays, electrons (e−) and holes (h+) are generated on the surface thereof. The electrons react with oxygen on the surface of the titanium oxide to generate superoxide anion O2-. In addition, holes react with moisture in the air to generate hydroxyl radicals OH. The hydroxyl radical generated in the above process has an ability to oxidatively decompose strong organic substances. Hydroxy radicals decompose odor substances, viruses, and bacteria present in the air into water and carbon dioxide. Therefore, according to the aspect of the disclosure, when the UV irradiation device 200 transmits UV rays to the photocatalyst 135, active oxygen may be generated in the photocatalyst 135 and the active oxygen may remove odor substances, viruses and bacteria.

When the air cleaner 1 operates, a process in which air outside the main body 10 is introduced into the main body 10 and after passing through the filter device 100, discharged to the outside of the main body 10 is repeated. In this process, the photocatalytic filter 130 adsorbs harmful substances in the gas component. According to the aspect of the disclosure, the UV LED 242 transmits UV rays to the photocatalytic filter 130 to thereby decompose harmful substances in the gas component adsorbed on the photocatalytic filter 130. That is, harmful substances adsorbed on the photocatalytic filter 130 may be removed.

The frame 133 may be provided to accommodate the photocatalyst 135. The frame 133 may include the photocatalyst accommodating part 134 in which the photocatalyst 135 is accommodated. The photocatalyst accommodating part 134 may be provided in plural. According to an embodiment of the disclosure, the photocatalyst accommodating part 134 may be provided in the form of a honeycomb. However, the disclosure is not limited thereto. The photocatalyst accommodating part may be provided in various shapes as long as it can have an internal space.

The frame 133 may have front and rear surfaces that are open. Due to such structure, it is difficult for the photocatalyst 135 to maintain a state of being accommodated in the photocatalyst accommodating part 134. According to an embodiment of the disclosure, the first cover 131 and the second cover 132 may be coupled to the front surface and the rear surface of the frame 133, respectively.

The first cover 131 and the second cover 132 may be provided as a fine mesh including a plurality of holes. However, the disclosure is not limited thereto. The first cover 131 and the second cover 132 may be provided in a structure including a hole formed to allow air to pass therethrough, in which the hole is provided smaller than the photocatalyst 135 to prevent the photocatalyst 135 from escaping through the hole.

According to the aspect of the disclosure, the photocatalytic filter 130 may be provided to be easily replaced. Specifically, the photocatalytic filter 130 may be easily separated from the main body 10 without a separate tool, and the photocatalytic filter 130 separated from the main body 10 may be replaced. Since the photocatalytic filter 130 is provided as a separate component detachable from the UV irradiation device 200, the photocatalytic filter 130 may be replaced, independent of the UV irradiation device 200. In addition, when the photocatalytic filter 130 is separated from the main body 10, a separate tool may not be required.

Figure 8:
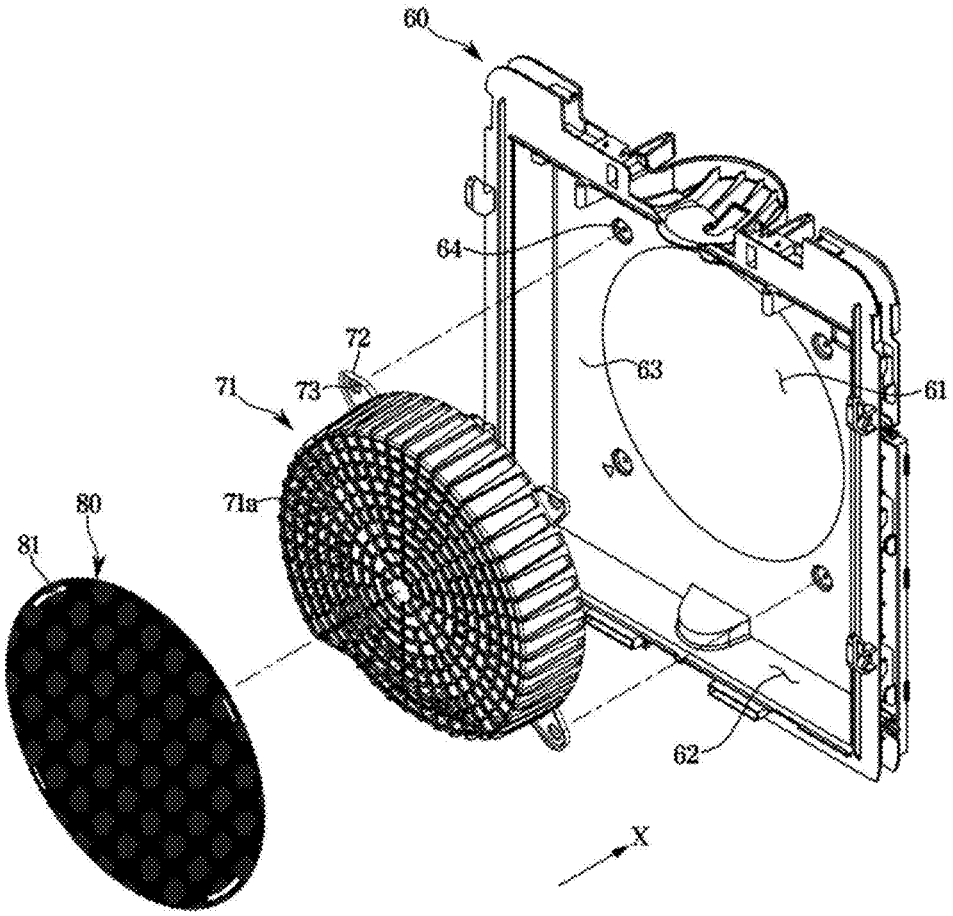
FIG. 8 is a view illustrating a fan case, a grille cover, and a light blocking member separated from each other, in an air cleaner according to an embodiment of the disclosure.
Figure 9:
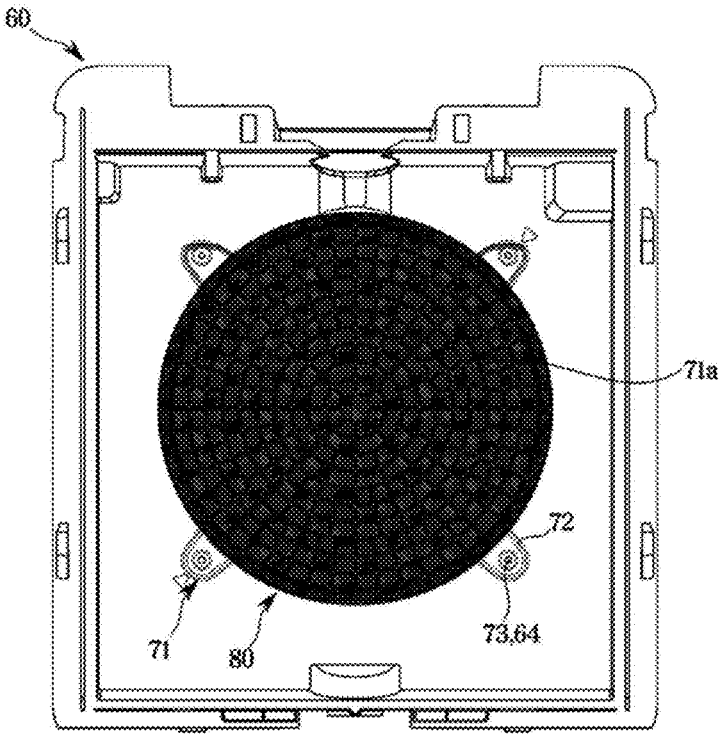
FIG. 9 is a view illustrating the fan case, the grille cover, and the light blocking member shown in FIG. 8 coupled to each other, which is seen at a different angle.

FIG. 8 is a view illustrating a fan case, a grille cover, and a light blocking member separated from each other, in an air cleaner according to an embodiment of the disclosure. FIG. 9 is a view illustrating the fan case, the grille cover, and the light blocking member shown in FIG. 8 coupled to each other, which is shown at a different angle.

According to an embodiment of the disclosure, the air cleaner 1 may include the fan case 60, the grille cover 71, and the second light blocking member 80 that are disposed in front of the filter case 50.

A blower fan 70 (see FIG. 14) may be coupled to the fan case 60. The blower fan 70 may be coupled to the front of the fan case 60. The fan case 60 may include an opening 61 corresponding to the blower fan 70 such that air is introduced into the blower fan 70. The fan case 60 may include a partition wall part 63 to prevent air from flowing to a portion other than the opening 61. In addition, the fan case 60 may include a flow path 62 formed by four sidewalls and the partition wall part 63. The flow path 62 may refer to an inner space of the fan case 60. The fan case 60 may include a second coupling part 64 corresponding to a first coupling part 73 of the grille cover 71 to be described below. The second coupling part 64 may be provided on one side of the partition wall part 63. The second coupling part 64 may be provided in plural.

The fan case 60 may be coupled at the rear side thereof to the grille cover 71. The grille cover 71 may prevent foreign substances from being introduced into the blower fan 70. For example, the grille cover 71 may prevent a user from approaching the blower fan 70 from the rear side of the fan case 60. The grille cover 71 may prevent children from accidentally approaching the blower fan 70 and being injured while the blower fan 70 is operating.

The grille cover 71 may include a plurality of holes 71*a* formed to allow air to pass therethrough. The hole 71*a* may be formed over the entire surface of the grille cover 71. Specifically, the hole 71*a* may be formed over the rear surface and the side surface of the grille cover 71.

The grille cover 71 may include the first coupling part 73 to be coupled to the fan case 60. The first coupling part 73 may be formed on a protrusion 72 protruding to the side of the fan case 60. According to an embodiment of the disclosure, the protrusion 72 and the first coupling part 73 may be provided in plural. The plurality of protrusions 72 may be disposed to be spaced apart from each other along the circumference of the grille cover 71.

According to the aspect of the disclosure, the air cleaner 1 may include the second light blocking member 80. The second light blocking member 80 may be provided to surround the grille cover 71. As the second light blocking member 80 covers the entire surface of the grille cover 7, UV rays may be prevented from being emitted to the outside through the grille cover 71.

According to an embodiment of the disclosure, UV rays may pass only through the opening 61 of the fan case 60. This is because the partition wall part 63 is provided to prevent water, air, and UV rays from passing therethrough. The grille cover 71 is coupled to the fan case 60 to cover the opening 61. As described above, since the grille cover 71 includes a plurality of holes 71*a*, UV rays may pass through the opening 61 of the fan case 60 through the holes 71*a*. UV rays, after passing through the opening 61, may be emitted to the outside of the main body 10 through the outlet 22 of the front panel 20. When UV rays are emitted to the outside of the main body 10, the safety standards may not be satisfied, which is a problem.

The second light blocking member 80 may prevent UV rays from being emitted to the outside of the main body 10. More specifically, the second light blocking member 80 may prevent UV rays from being emitted toward the front of the main body 10. The second light blocking member 80 may be provided to cover the grille cover 71 through which UV rays needs to pass before passing through the fan case 60. The second light blocking member 80 may be provided to cover not only the rear surface of the grille cover 71 but also the entire side surface of the grille cover 71. The second light blocking member 80 may be provided to prevent UV rays from passing therethrough. Since the second light blocking member 80 covers the grille cover 71, UV rays do not pass through the grille cover 71 and the opening 61 of the fan case 60, and thus are prevented from being emitted to the outside of the main body 10. Different from the drawing, the grille cover 71 may not be coupled to the fan case 60. That is, the grille cover 71 may be omitted. In this case, the second light blocking member 80 may be provided to directly cover the opening 61.

Similar to the first light blocking member 220, the second light blocking member 80 may also be formed of a fabric material. In addition, the second light blocking member 80 may be provided in a black color to easily absorb light. However, the disclosure is not limited thereto, and the second light blocking member may be provided as a metal plate including a plurality of holes formed over the entire surface thereof. In addition, the second light blocking member may be formed of an injection molding material rather than a metal material.

The second light blocking member 80 may include a second coupling hole 81. The second coupling hole 81 may be provided in plural. The plurality of second coupling holes 81 may be provided to be spaced apart from each other along the circumference of the second light blocking member 80.

Referring to FIGS. 8 and 9, the second light blocking member 80 may be coupled to the grille cover 71 as the protrusion 72 of the grille cover 71 is inserted into the second coupling hole 81. The number of the second coupling holes 81 may be provided to correspond to the number of the protrusions 72. As the protrusion 72 is inserted into the second coupling hole 81, the second light blocking member 80 may cover the rear surface and the entire side surface of the grille cover 71. As described above, when the second light blocking member 80 covers the grille cover 71, emission of UV rays through the grille cover 71 may be blocked. The partition wall part 63 of the fan case 60 may be formed of an injection-molded material to prevent UV rays from passing therethrough. However, the material is not limited. Since UV rays do not pass through the partition wall part 63 and the second light blocking member 80, according to the aspect of the disclosure, UV rays may be prevented from passing from the rear of the fan case 60 to the front.

Figure 10:
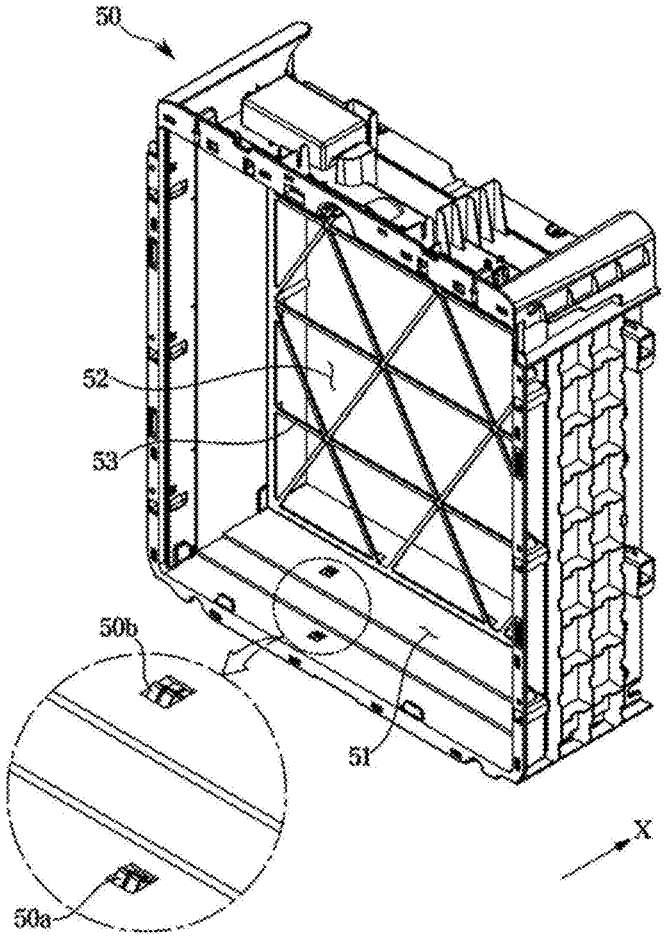
FIG. 10 is a view separately illustrating a filter case of an air cleaner according to an embodiment of the disclosure.

FIG. 10 is a view separately illustrating a filter case of an air cleaner according to an embodiment of the disclosure.

Referring to FIG. 10, the filter case 50 may include a first contact point 50*a* and a second contact point 50*b*. The first contact point 50*a* and the second contact point 50*b* may each be provided on an inner lower surface of the filter case 50. However, the positions of the first contact point and the second contact point are not limited. The first contact point and the second contact point may be provided on an inner side surface of the filter case.

Figure 11:
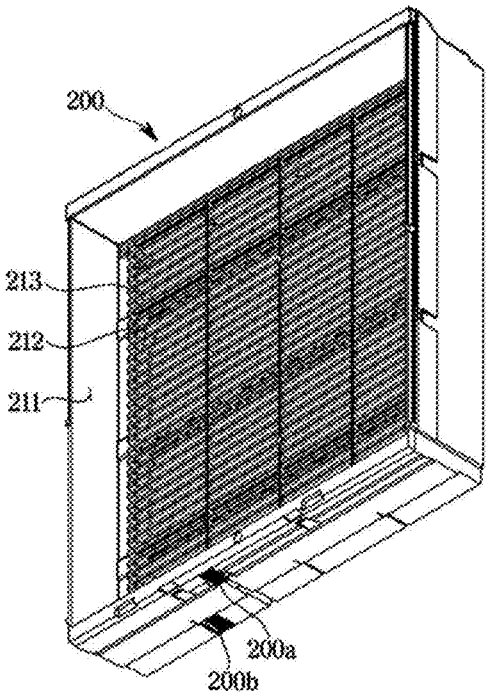
FIG. 11 is a view separately illustrating an ultraviolet irradiation device of an air cleaner according to an embodiment of the disclosure.

FIG. 11 is a view separately illustrating an ultraviolet irradiation device of an air cleaner according to an embodiment of the disclosure.

Referring to FIG. 11, the UV irradiation device 200 may include a third contact point 200*a* and a fourth contact point 200*b*. The third contact point 200*a* and the fourth contact point 200*b* may each be respectively provided on an outer lower surface of the UV irradiation device 200. However, the positions of the third and fourth contact points are not limited. The third contact point and the fourth contact point may be provided on an outer side surface of the UV irradiation device 200 to correspond to the first contact point and the second contact point.

Figure 12:
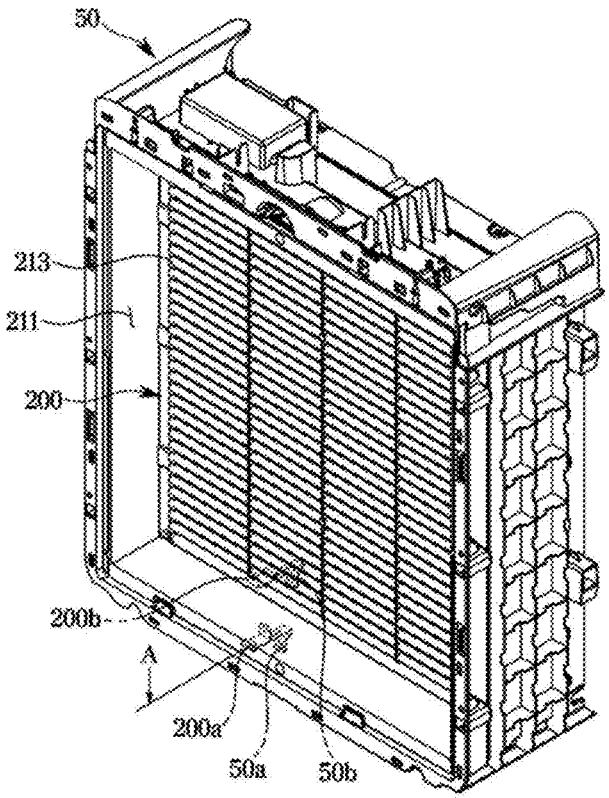
FIG. 12 is a view illustrating a filter case and an ultraviolet irradiation device mounted on the filter case in an air cleaner according to an embodiment of the disclosure.
Figure 13:
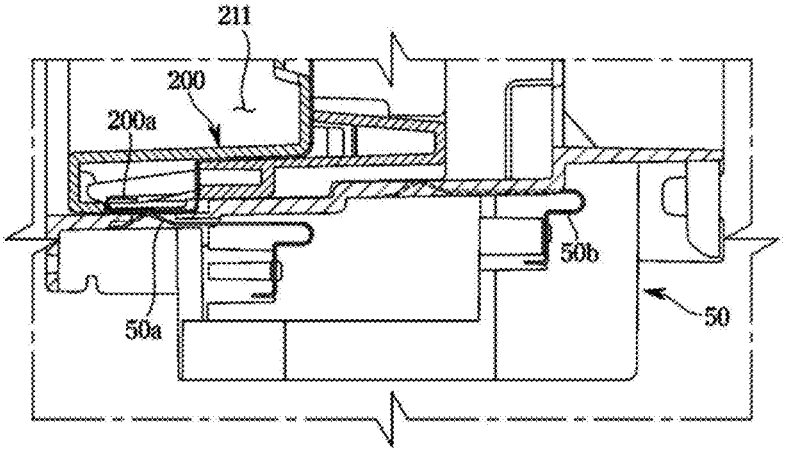
FIG. 13 is a cross-sectional view taken along line A of FIG. 12.

FIG. 12 is a view illustrating a filter case and an ultraviolet irradiation device mounted on the filter case, in an air cleaner according to an embodiment of the disclosure. FIG. 13 is a cross-sectional view taken along line A of FIG. 12.

Referring to FIGS. 12 and 13, the first contact point 50*a* and the third contact point 200*a* may be provided to come in contact each other when the UV irradiation device 200 is mounted on the filter case 50. The second contact point 50*b* and the fourth contact point 200*b* may be provided to come in contact with each other when the UV irradiation device 200 is mounted on the filter case 50.

When the UV irradiation device 200 is mounted on the filter case 50, the first contact point 50*a* and the third contact point 200*a* may be electrically connected to each other by making contact with each other, and the second contact point 50*b* and the fourth contact point 200*b* may be electrically connected to each other by making contact with each other. The first contact point 50*a* and the second contact point 50*b* of the filter case 50 may be connected to a power supply source (not shown) outside the main body 10 to receive power. The third contact point 200*a* and the fourth contact point 200*b* may receive power from the inside of the main body 10 by making contact with the first contact point 50*a* and the second contact point 50*b*, respectively. Accordingly, when the UV irradiation device 200 is mounted on the filter case 50, the UV irradiation device 200 may receive power. With such a structure, the UV irradiation device 200 according to the aspect of the disclosure may receive power by only being installed on the main body 10 without a wire or a power supply device connected to a power source, and allow the UV LED 242 to transmit UV light.

Figure 14:
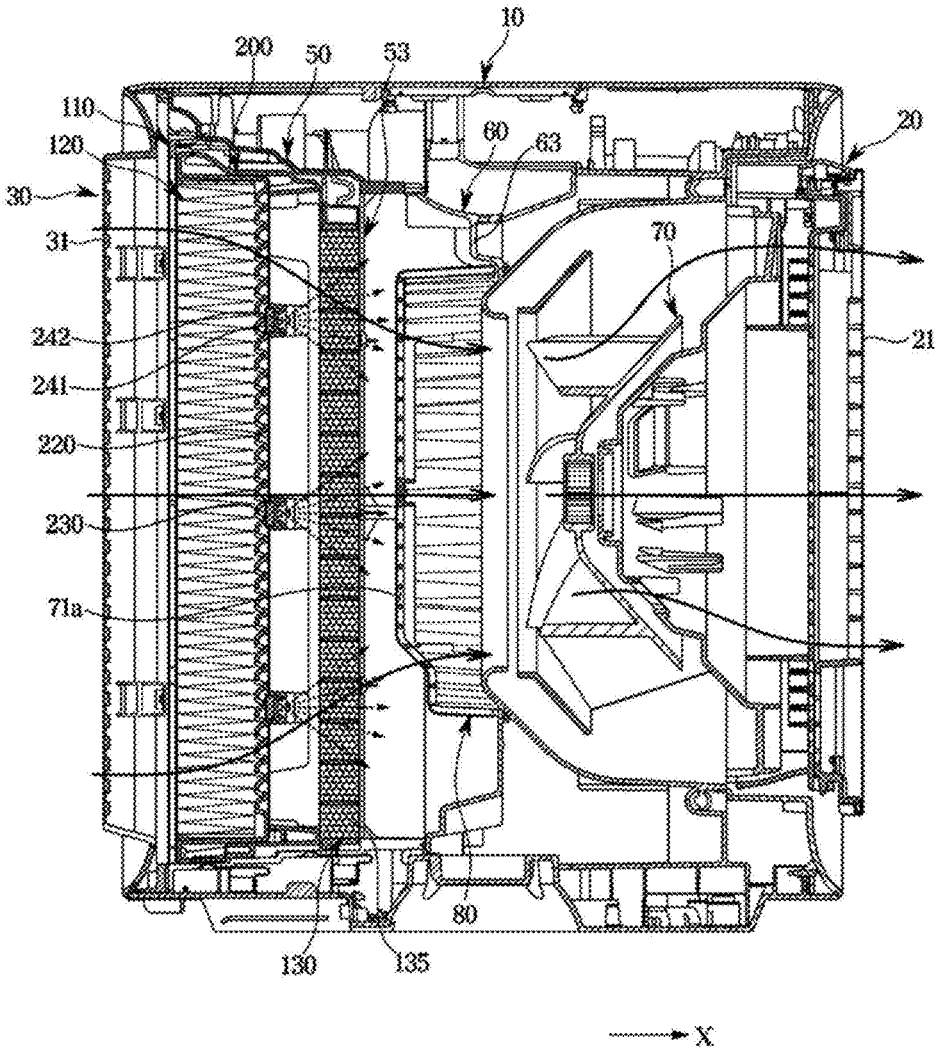
FIG. 14 is a side cross-sectional view of an air cleaner according to an embodiment of the disclosure.

FIG. 14 is a side cross-sectional view of an air cleaner according to an embodiment of the disclosure.

Hereinafter, the flow of air in the air cleaner 1 according to an embodiment of the disclosure will be described in detail with reference to FIG. 14.

According to an embodiment of the disclosure, air outside the air cleaner 1 may be introduced into the main body 10 through the suction part 31 provided on the rear panel 30 of the main body 10. In this case, the air outside the main body 10 may be introduced into the main body 10 by the blower fan 70 rotated by a driving motor (not shown). The air introduced into the main body 10 through the suction part 31 may pass through the above-described primary filter 110 and secondary filter 120. While passing through the primary filter 110 and the secondary filter 120, dust in the air may be filtered out. In this case, some bacteria and viruses may be filtered out by the primary filter 110 and the secondary filter 120, but bacteria and viruses are not completely filtered out.

Dust contained in the air introduced into the main body 10 may be removed while passing through the primary filter 110 and the secondary filter 120. However, there is a need to remove bacteria and viruses that are not completely removed. According to the aspect of the disclosure, the UV irradiation device 200 may be provided to transmit UV rays in the first direction X. The first direction X may face the front of the main body 10. The UV irradiation device 200 may be provided at the front side thereof with the photocatalytic filter 130. The photocatalytic filter 130 may react with the UV rays transmitted from the UV irradiation device 200 to generate active oxygen. Active oxygen may remove bacteria and viruses. According to the above process, the air cleaner 1 may remove 99% or more of bacteria and viruses contained in the air that has passed through the primary filter 110 and the secondary filter 120.

According to the aspect of the disclosure, the UV irradiation device 200 may transmit UV rays in a direction parallel to the first direction X. In other words, the UV LED 242 may be disposed to face the front of the main body 10. In addition, the photocatalytic filter 130 may be disposed to face the UV LED 242. That is, along the first direction X from the rear panel 30 disposed on the rear surface of the main body 10, the UV LED 242 may be arranged first, followed by the photocatalytic filter 130. The UV LED 242 may be arranged at the front end of the air flow path, and the photocatalytic filter 130 may be disposed at the rear end of the air flow path. By the arrangement of the UV LED 242 and the photocatalytic filter 130, the air cleaner 1 according to the aspect of the disclosure may more effectively remove bacteria and viruses. The air introduced into the main body 10 passes through the UV LED 242 and then flows into the photocatalytic filter 130. When air is introduced into the photocatalytic filter 130, the photocatalyst filter 130 is provided with sufficient amount of active oxygen that is generated by the photocatalyst 135 reacting with UV rays, so that the removal efficiency of bacteria and viruses may be improved. That is, a sufficient amount of active oxygen is generated at an inlet part of the photocatalytic filter 130, into which air is introduced, so that the removal efficiency of bacteria and viruses may be improved.

In the photocatalytic filter 130, a surface of the photocatalytic filter 130 on which bacteria and viruses are most frequently collected is a surface of the photocatalytic filter 130 through which air is introduced. According to an embodiment of the disclosure, the surface through which air is introduced is the rear surface of the photocatalytic filter 130. This is because air before flowing into the photocatalytic filter 130 contains a relatively large amount of bacteria and viruses, and air is introduced through the rear surface of the photocatalytic filter 130, sequentially passing through the front surface of the photocatalytic filter 130, moves to the front of the main body 10.

According to the aspect of the disclosure, the UV LED 242 may be disposed to transmit UV rays toward the rear surface of the photocatalytic filter 130 on which bacteria and viruses are most frequently collected. As described above, the UV LED 242 may be disposed on the front end of the flow path, and the photocatalytic filter 130 may be disposed on the rear end of the flow path. With such an arrangement, UV rays are transmitted toward the rear surface of the photocatalytic filter 130, on which a large amount of bacteria and viruses are collected, and active oxygen generated on the rear surface of the photocatalytic filter 130 may remove the bacteria and viruses. Accordingly, the removal efficiency of bacteria and viruses may be improved.

Conversely, when the photocatalyst filter is disposed on the front end in the air flow path and the UV LED is disposed on the rear end in the air flow path, active oxygen is caused to be present in the outlet part of the photocatalytic filter. In this case, since active oxygen is present in the outlet part of the photocatalyst filter, through which air is discharged, the removal efficiency of bacteria and viruses is relatively reduced.

According to the aspect of the disclosure, as described above, the UV LED 242 is disposed upstream of the photocatalytic filter 130 in the air flow path, so that the removal efficiency of bacteria and viruses may be improved.

In addition, according to the aspect of the disclosure, light blocking members are disposed at the front side and rear side of the UV irradiation device 200, respectively, to block the UV rays generated inside the main body 10 from being emitted to the outside of the main body 10. That is, light leakage of UV rays may be prevented.

UV rays transmitted to the front of the UV irradiation device 200 may be blocked by the second light blocking member 80 provided to cover the grille cover 71. In addition, UV rays reflected to the rear side of the main body 10 may be blocked by the first light blocking member 220 provided to cover one surface of the UV irradiation device 200. Specifically, the first light blocking member 220 may be provided to cover one surface of the first case 210 of the UV irradiation device 200.

As described above, the first light blocking member 220 and the second light blocking member 80 are respectively disposed at the front side and rear side of the UV LED 242 that transmits UV rays, so that the UV rays emitted from the inside of the main body 10 are prevented from leaking to the outside.

On the other hand, dust, bacteria and viruses contained in the air introduced into the main body 10 through the suction part 31 may be removed by passing through the primary filter 110, the secondary filter 120, the UV irradiation device 200, and the photocatalytic filter 130. Therefore, the air cleaner 1 according to the aspect of the disclosure may remove bacteria and viruses as well as dust, thereby preventing propagation of pathogens harmful to the human body or infection of viruses.

One aspect of the disclosure provides an air cleaner capable of removing bacteria and viruses.

Another aspect of the disclosure provides an air cleaner capable of removing bacteria and viruses by irradiating a photocatalyst with ultraviolet (UV) rays to generate active oxygen.

Another aspect of the disclosure provides an air cleaner capable of blocking UV rays transmitted from the inside of the main body from being emitted to the outside of the main body.

Although the disclosure has been shown and described in relation to specific embodiments, it would be appreciated by those skilled in the art that changes and modifications may be made in these embodiments without departing from the principles and scope of the disclosure, the scope of which is defined in the claims and their equivalents.

What is claimed is:

1. An air cleaner comprising:

a main body including:

a suction hole through which air is introduced into the main body, and a discharge hole through which the air is discharged from the main body;

an ultraviolet (UV) irradiation device between the suction hole and the discharge hole, the UV irradiation device including:

a UV light emitting diode (UV LED) configured to emit UV rays toward the discharge hole, a substrate extended in a first direction on which the UV LED is mounted, a heat sink in contact with the substrate and configured to absorb heat from the substrate, a first case, and a second case coupled to the first case and including:

a substrate accommodating part in front of the substrate and including:

an UV hole through which the UV rays emitted from the UV LED are transmittable, and a plurality of heat dissipation grooves recessed at both ends in a second direction perpendicular to the first direction that expose a front surface of the substrate to the air and through which the air is passable to contact the exposed front surface of the substrate such that the exposed front surface of the substrate exchanges heat with the air, wherein the first case and the second case are configured so that the UV LED, the substrate, and the heat sink are between the first case and the second case, and the UV LED and the substrate are accommodated in the substrate accommodating part;

a photocatalyst filter between the UV irradiation device and the discharge hole and including a photocatalyst, the photocatalyst configured to generate active oxygen by reacting with the UV rays emitted from the UV LED; and a light blocking member between the UV LED and the suction hole, the light blocking member configured to prevent the UV rays emitted from the UV LED from being emitted to an outside of the main body through the suction hole.

2. The air cleaner of claim 1, wherein the light blocking member is a first light blocking member, and the air cleaner further includes a second light blocking member between the UV LED and the discharge hole, the second light blocking member configured to prevent the UV rays emitted from the UV LED from being emitted to the outside of the main body through the discharge hole.

3. The air cleaner of claim 1, further comprising a filter between the suction hole and the UV irradiation device, the filter configured to filter out dust from the air introduced into the main body.

4. The air cleaner of claim 3, wherein the UV irradiation device further includes:

a filter accommodating part in which the filter is mountable, and an air flow-in part configured to allow the air to pass therethrough.

5. The air cleaner of claim 4, wherein the first case includes the filter accommodating part.

6. The air cleaner of claim 5, wherein the light blocking member is between the first case and the heat sink, and covers a side of the first case that faces the heat sink.

7. The air cleaner of claim 5, wherein the heat sink is between the first case and the substrate and is configured to contact the air passed through the air flow-in part.

8. The air cleaner of claim 2, wherein the first light blocking member includes a first construction including at least one of a first fabric, a first metal plate having a plurality of holes, or a first injection molded material, and the second light blocking member includes a first construction including at least one of a second fabric, a second metal plate having a plurality of holes, or a second injection molded material.

9. The air cleaner of claim 2, further comprising:

a fan inside the main body and configured to cause the air to flow into the air cleaner;

a fan case including an opening corresponding to the fan, the fan case configured to guide the air passed through the UV irradiation device and the photocatalyst filter to the fan; and a grille cover couplable to the fan case and configured to cover the opening.

10. The air cleaner of claim 9, wherein the second light blocking member is configured to cover the opening or the grille cover to prevent UV rays from passing through the opening.

11. The air cleaner of claim 1, wherein the photocatalyst includes titanium oxide ($TiO_2$).

12. The air cleaner of claim 1, further comprising a filter case in which the UV irradiation device and the photocatalyst filter are mountable, wherein the filter case includes a first contact point and a second contact point that are configured to transmit electricity.

13. The air cleaner of claim 12, wherein the UV irradiation device further includes:

a third contact point, and a fourth contact point, and the filter case and the UV irradiation device are configured so that, with the UV irradiation device mounted in the filter case, the first contact point contacts and is thereby electrically connected with the third contact point at a first electrical connection, the second contact point contacts and is thereby electrically connected with the fourth contact point at a second electrical connection, and the UV irradiation device receives electrical power from the filter case through the first electrical connection and the second electrical connection.

14. The air cleaner of claim 1, wherein the suction hole is on a rear surface of the main body, and the discharge hole is on a front surface of the main body.

15. An air cleaner comprising:

a main body including:

a suction hole through which air is introduced into the main body, and a discharge hole through which the air is discharged from the main body;

an ultraviolet (UV) irradiation device between the suction hole and the discharge hole, and including:

a UV light emitting diode (UV LED) to emit UV rays toward the discharge hole, a substrate on which the UV LED is mounted, and a heat sink on a rear surface of the substrate such that the substrate is between the heat sink and the UV LED, the heat sink configured to absorb heat from the substrate, wherein the substrate and the heat sink extend in a direction that crosses a flow of the air through the air cleaner such that the heat sink transfers the absorbed heat to the air;

a photocatalyst filter including a photocatalyst to generate active oxygen by reacting with the UV rays emitted from the UV LED, and the photocatalyst filter between the UV irradiation device and the discharge hole;

a first light blocking member on a back surface of the heat sink and between the UV LED and the suction hole, the first light blocking member configured to prevent the UV rays emitted from the UV LED from being emitted to an outside of the main body through the suction hole; and a second light blocking member between the UV LED and the discharge hole to prevent the UV rays emitted from the UV LED from being emitted to the outside of the main body through the discharge hole.

16. The air cleaner of claim 1, wherein the UV LED is among a plurality of UV LEDs, and the plurality of heat dissipation grooves are between UV LEDs of the plurality of UV LEDs.

* * * * *